US007430298B2

(12) United States Patent
Sekine

(10) Patent No.: US 7,430,298 B2
(45) Date of Patent: Sep. 30, 2008

(54) SOUND FIELD CONTROLLER

(75) Inventor: Satoshi Sekine, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 770 days.

(21) Appl. No.: 10/818,808

(22) Filed: Apr. 6, 2004

(65) Prior Publication Data

US 2004/0228498 A1 Nov. 18, 2004

(30) Foreign Application Priority Data

Apr. 7, 2003 (JP) ..... 2003-103004

(51) Int. Cl.
*H04R 5/02* (2006.01)

(52) U.S. Cl. ..... 381/303

(58) Field of Classification Search ..... 381/17, 381/18, 303, 300

See application file for complete search history.

(56) References Cited

U.S. PATENT DOCUMENTS

| | | | | |
|---|---|---|---|---|
| 5,682,433 | A | 10/1997 | Pickard | |
| 5,715,318 | A * | 2/1998 | Hill et al. | 381/17 |
| 2003/0118192 | A1 | 6/2003 | Sasaki | |

FOREIGN PATENT DOCUMENTS

| | | |
|---|---|---|
| JP | 07-222299 | 8/1995 |
| JP | 08-126099 | 5/1996 |
| JP | 11-355900 | 12/1999 |
| JP | 2002-084599 | 3/2002 |

OTHER PUBLICATIONS

Japanese Patent Office, "Office Action," (Jul. 4, 2006).
Japanese Office Action, "Notice of Reasons for Rejection" in regard to Patent Appln. No. 2003-103004, (Jan. 16, 2007).

* cited by examiner

*Primary Examiner*—Ping Lee
(74) *Attorney, Agent, or Firm*—Pillsbury Winthrop Shaw Pittman LLP

(57) ABSTRACT

A sound field controller including a plurality of output channels for respectively supplying signals to a plurality of speakers, includes: a weighting-coefficient outputting unit which outputs weighting coefficients for determining how the signals on the plurality of channels for reproducing a sound field are to be distributed to the output channels, according to a relative positional relationship between the sound field and a listener; an input unit which inputs positional relation data indicating the relative positional relationship; and a distribution controller which distributes the signals on the plurality of channels to the output channels on the basis of the outputted weighting coefficients according to the inputted positional relation data.

6 Claims, 13 Drawing Sheets

SOUND FIELD CONTROLLER

BACKGROUND OF THE INVENTION

The present invention relates to a sound field controller for controlling the sound field when acoustic signals are reproduced by multi-channel speakers.

A so-called surround pan pot, which controls the position of a sound image by a sound reproducing apparatus (a multi-channel reproducing system) using multi-channel speakers, has been put to practical use. This is a technique whereby the sound image of a subject sound (e.g., a specific musical instrument or voice) is localized by controlling the volume and the sound generating timing of the musical sound which is generated from the respective speakers, and presence is imparted to the sound (e.g., patent document 1).

Patent Document 1

JP-A-8-205296

However, although the sound field is formed as a plurality of sound images and reverberations in a space are integrated, it is extremely difficult to move this sound field itself.

The invention described in patent document 1 controls the movement of a single sound image, but in a case where a multiplicity of sound images are to be moved simultaneously, it is necessary to simultaneously effect the above-described sound image position control with respect to the signals of the respective sounds. Specifically, it is necessary to simultaneously control pan pots of the respective signals.

SUMMARY OF THE INVENTION

The invention has been devised against the above-described background, and its object is to provide a sound field controller which realizes the sound field control of the reproduced sound of the multi-channel reproducing system more easily.

In order to solve the aforesaid object, the invention is characterized by having the following arrangement.

(1) A sound field controller including a plurality of output channels for respectively supplying signals to a plurality of speakers, comprising:

a weighting-coefficient outputting unit which outputs weighting coefficients for determining how the signals on the plurality of channels for reproducing a sound field are to be distributed to the output channels, according to a relative positional relationship between the sound field and a listener;

an input unit which inputs positional relation data indicating the relative positional relationship; and a distribution controller which distributes the signals on the plurality of channels to the output channels on the basis of the outputted weighting coefficients according to the inputted positional relation data.

(2) The sound field controller according to claim 1, wherein the positional relation data includes information indicating an angle of offset of the sound field from an axis directed toward one of the speakers.

(3) The sound field controller according to claim 1, further comprising a positional-relation computing unit which prepares the positional relation data on the basis of a predetermined function, the positional-relation computing unit being provided in place of or in addition to the input unit, wherein the distribution controller distributes output signals from an output device to the output channels on the basis of the positional relation data inputted by one of the input unit and the positional-relationship computing unit.

(4) The sound field controller according to claim 1, wherein the weighting-coefficient outputting unit outputs the weighting coefficients so that the sound field changes.

(5) The sound field controller according to claim 4, wherein the change of the sound field includes a rotation of the sound field, enlarging and reducing of the sound field, movement of the sound field, and a combination thereof.

(6) A computer readable recording medium storing a program for allowing a computer to realize:

a weighting-coefficient outputting function for outputting predetermined weighting coefficients according to a relative positional relationship between a sound field and a listener to distribute signals on a plurality of channels for reproducing the sound field to the plurality of output channels according to the predetermined weighting coefficients;

an inputting function for accepting the input of positional relation data indicating the relative positional relationship; and a distribution controlling function for distributing the signals on the plurality of channels to the output channels on the basis of the outputted weighting coefficients corresponding to the positional relation data whose input has been accepted by the inputting function.

By using the above-described means, it becomes possible to realize the sound field control of the reproduced sound of the multi-channel reproducing system more easily.

DETAILED DESCRIPTION OF PREFERRED EMBODIMENTS

Hereafter, a description will be given of an embodiment of the invention with reference to the drawings.

Configuration of the Embodiment

Figure 1:
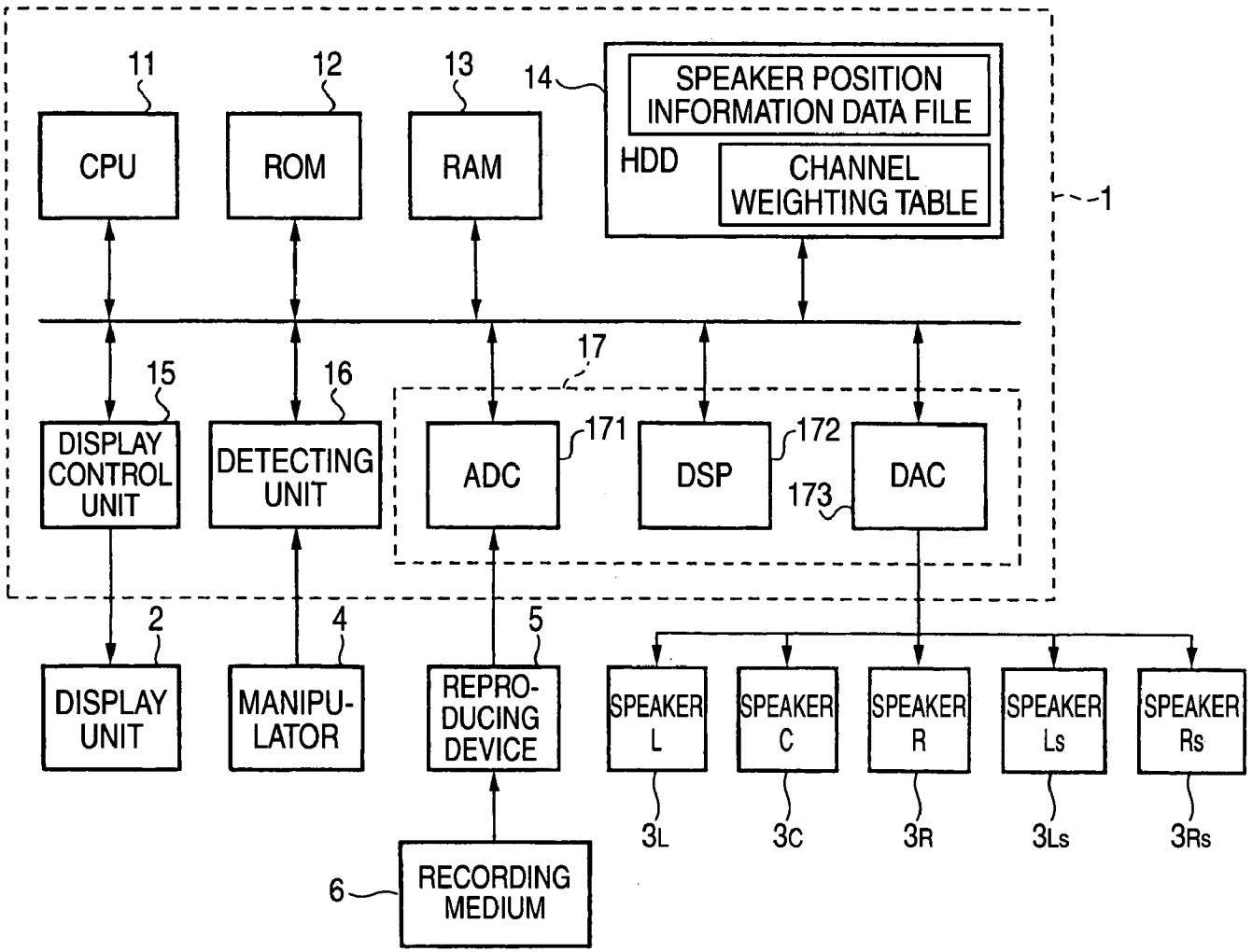
FIG. 1 is a block diagram illustrating the configuration of a sound field controller in accordance with an embodiment.

FIG. 1 is a block diagram illustrating the configuration of a sound field controller in accordance with an embodiment of the invention. Reference numeral 1 denotes a sound field controller body. A display unit 2 for providing various displays, output channels consisting of speakers $\mathbf{3}_L$, $\mathbf{3}_R$, $\mathbf{3}_{Ls}$, $\mathbf{3}_{Rs}$, and $\mathbf{3}_C$, and a manipulator 4 for inputting sound field position information are connected to the sound field controller body 1. Musical sound data recorded in a recording medium 6 such as a digital versatile disk (DVD) is reproduced as the musical sound data is inputted to the sound field controller body 1 through a reproducing device 5. Furthermore, the manipulator 4 may be a mouse or a keyboard, or a joystick or a trackball, or these devices may be used in combination.

Output channels of the reproducing device 5 are, for example, the standard 5.1 channels represented by the Dolby (registered trademark) digital system (AC-3: registered trademark), and adopt a channel format corresponding to the reproducing positions of a left front (L), a right front (R), a left rear (Ls), a right rear (Rs), and a center (C), excluding an auxiliary channel for a low sound effect. These channels L, R, Ls, Rs, and C are preconditioned on the fact that they are reproduced by the respective speakers 3L, 3R, 3Ls, 3Rs, and 3C. Namely, the output signals from the reproducing device 5 are distributed to the respective output channels according to the sound field so as to reproduce the sound field with rich presence.

Figure 2:
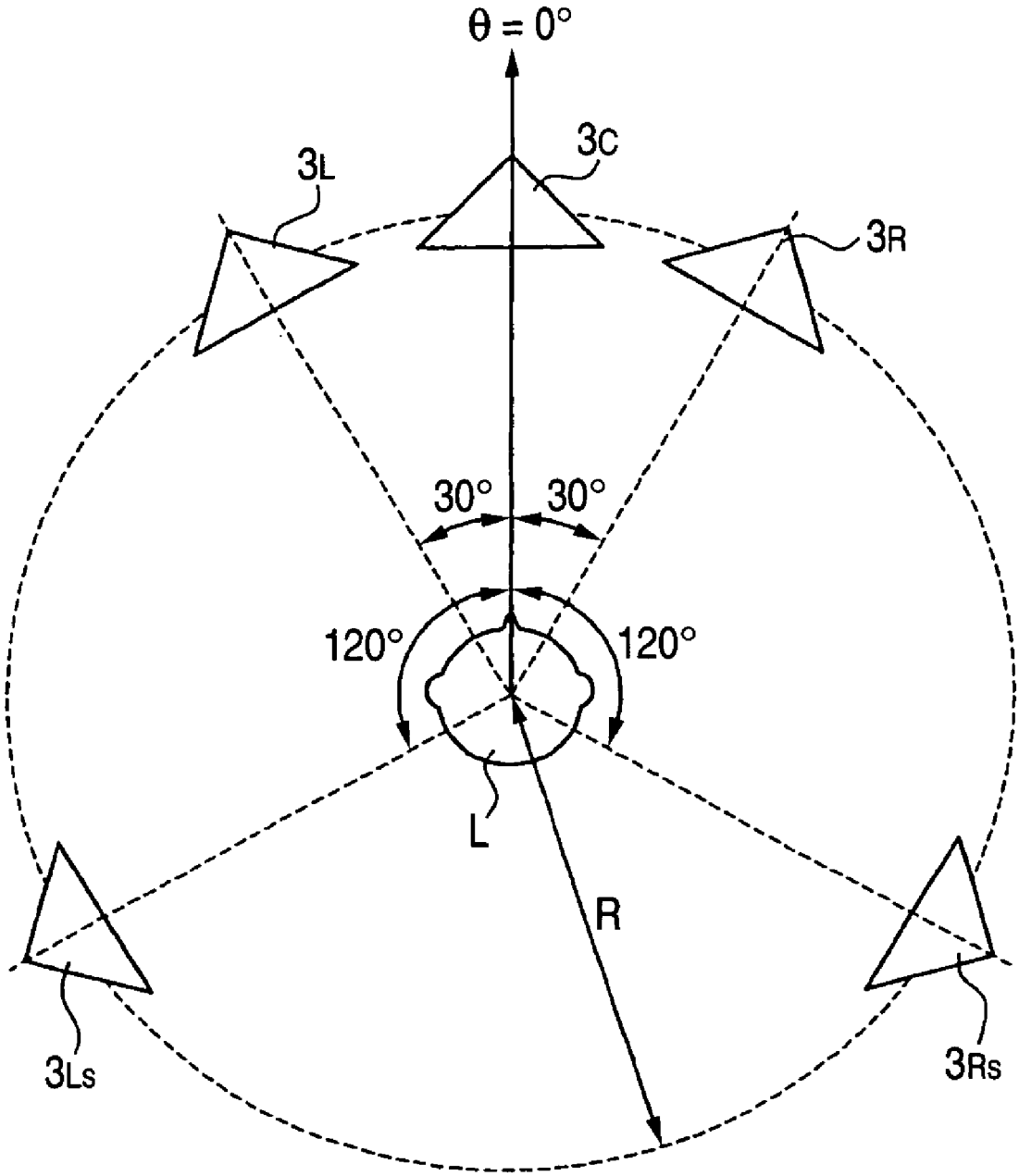
FIG. 2 is an example of the layout of speakers $\mathbf{3}_L$, $\mathbf{3}_R$, $\mathbf{3}_{Ls}$, $\mathbf{3}_{Rs}$, and $\mathbf{3}_C$ in the embodiment.

Here, the speakers $\mathbf{3}_L$, $\mathbf{3}_R$, $\mathbf{3}_{Ls}$, $\mathbf{3}_{Rs}$, and $\mathbf{3}_C$ are arranged as shown in FIG. 2. In the drawing, a listener L is located in such a manner as to orientate his or her face to the front with respect to the speaker 3C. A description will be given below of the positions of the respective speakers $\mathbf{3}_L$, $\mathbf{3}_R$, $\mathbf{3}_{Ls}$, $\mathbf{3}_{Rs}$, and $\mathbf{3}_C$ through a coordinate system using the listener L as an origin. To simplify the description, a polar coordinate system and a rectangular coordinate system are used as the coordinate system, as required. The speakers $\mathbf{3}_L$, $\mathbf{3}_R$, $\mathbf{3}_{Ls}$, $\mathbf{3}_{Rs}$, and $\mathbf{3}_C$ are arranged on a circumference at a distance R from the listener L. If it is assumed that the speaker 3C, i.e., the front, is 0°, the positions of the remaining speakers 3L, 3R, 3Ls, and 3Rs are 330° (−30°), 30°, 240° (−120°), and 120°, respectively. Hereafter, this layout of the speakers will be referred to as the "standard layout."

Next, referring again to FIG. 1, a description will be given of an outline of the internal electric configuration of the sound field controller body 1.

A CPU 11 uses a storage area of a RAM 13 as a work area, and by executing various programs stored in a ROM 12, the CPU 11 controls various units of the apparatus, and executes various operations such as the calculation of DSP coefficients.

A HDD (hard disk drive) 14 is an external storage device, and stores data such as a speaker position information data file and a channel weighting table. The speaker position information data file is a set of data in which the positions of the respective speakers $\mathbf{3}_L$, $\mathbf{3}_R$, $\mathbf{3}_{Ls}$, $\mathbf{3}_{Rs}$, and $\mathbf{3}_C$ are stored in the form of coordinates. Meanwhile, the channel weighting table is a table which describes output sound pressure levels of the respective channels corresponding to the angle of rotation θ. In this embodiment, the front of the listener L is set as θ=0, and θ is increased clockwise. It should be noted that the aforementioned HDD 14 may be another storage device insofar as it is capable of storing data such as the speaker position information data file and the channel weighting table, and is not limited to the hard disk drive.

A display control unit 15 effects control for displaying on the display unit 2 images such as movies and a graphical user interface (GUI) as an input means for inputting sound field position information.

A detecting unit 16 detects the input of the manipulator 4 and sends the result to the CPU 11. In addition, the input by the manipulator 4 is reflected on the display unit 2.

Figure 3:
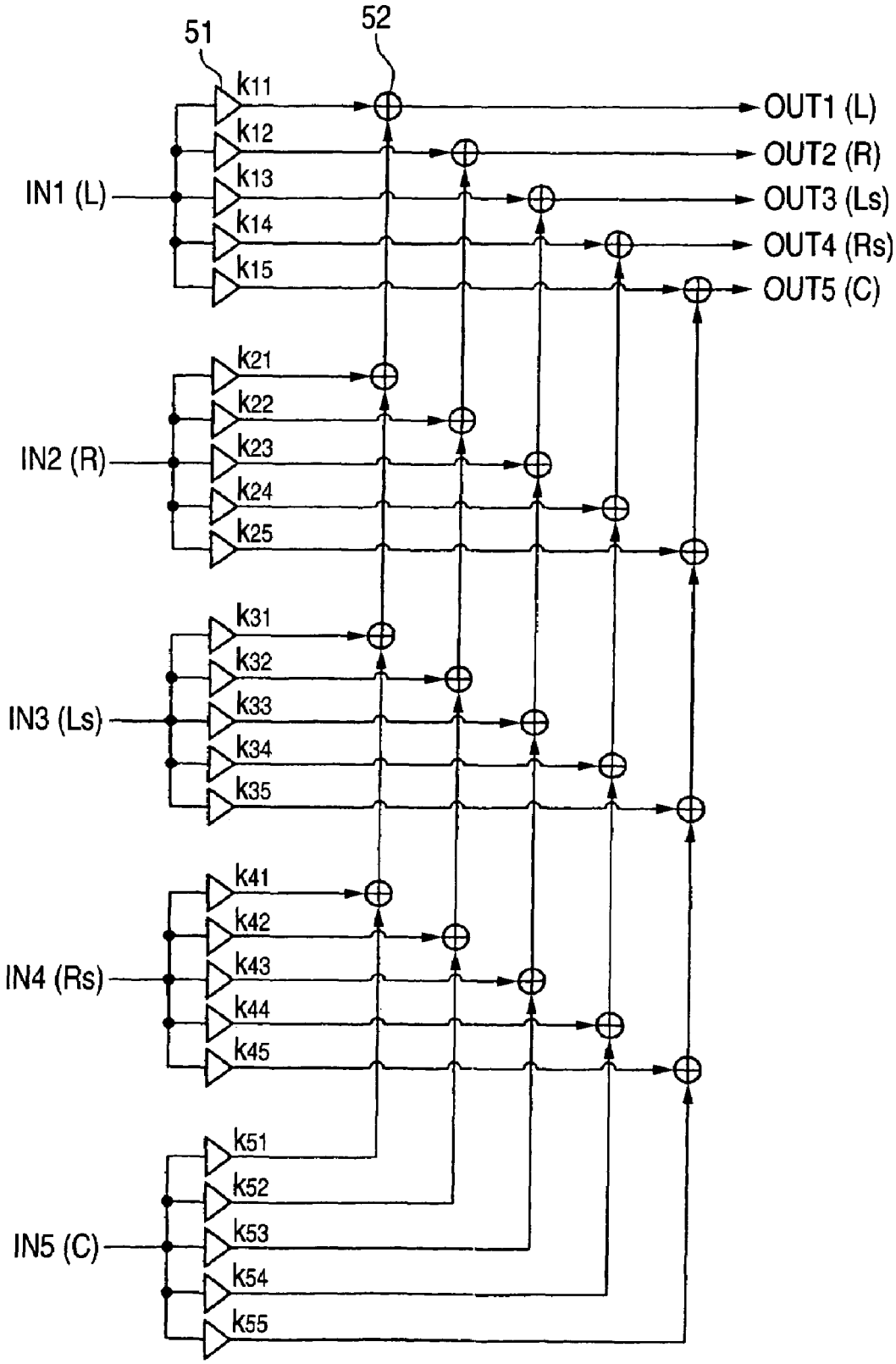
FIG. 3 is a diagram illustrating a matrix mixer in the embodiment.

A signal processing unit 17 consists of an A/D converter (ADC) 171 for converting analog acoustic signals to digital signals; a digital signal processor (DSP) 172 for controlling the levels, delay, and frequency characteristics of the respective output channels; and a D/A converter (DAC) 173 for converting data at the output channels to analog acoustic signals. In addition, the DSP 172 has the function of a matrix mixer shown in FIG. 3. It should be noted that, in FIG. 3, reference numeral 51 denotes an amplifier, and 52 denotes an adder.

The matrix mixer distributes multi-channel surround sources to the number of output channels, multiplies them by the DSP coefficients calculated by the CPU 11, and adds signals representing the results of multiplication for the respective output channels and outputs them so as to control the levels of the output channels, thereby realizing control of the sound field.

Operation of the Embodiments

Next, a description will be given of the operation of the sound field controller having the above-described configuration.

First, a situation is assumed in which the listener L located at the center performs operation in the speaker layout conforming to the standard layout. At this time, the listener L performs operation by using the manipulator 4 while viewing the GUI being displayed on the screen of the display unit 2. In the invention, in the sound field in which the speakers are arranged in the standard layout, it is possible to simultaneously effect three kinds of sound field control including the rotation of the sound field, enlargement/reduction of the sound field, and the movement of the sound field. Hereafter, a description will be given separately of the respective sound field control mentioned above.

OPERATION EXAMPLE 1

Rotation of Sound Field

Figure 4:
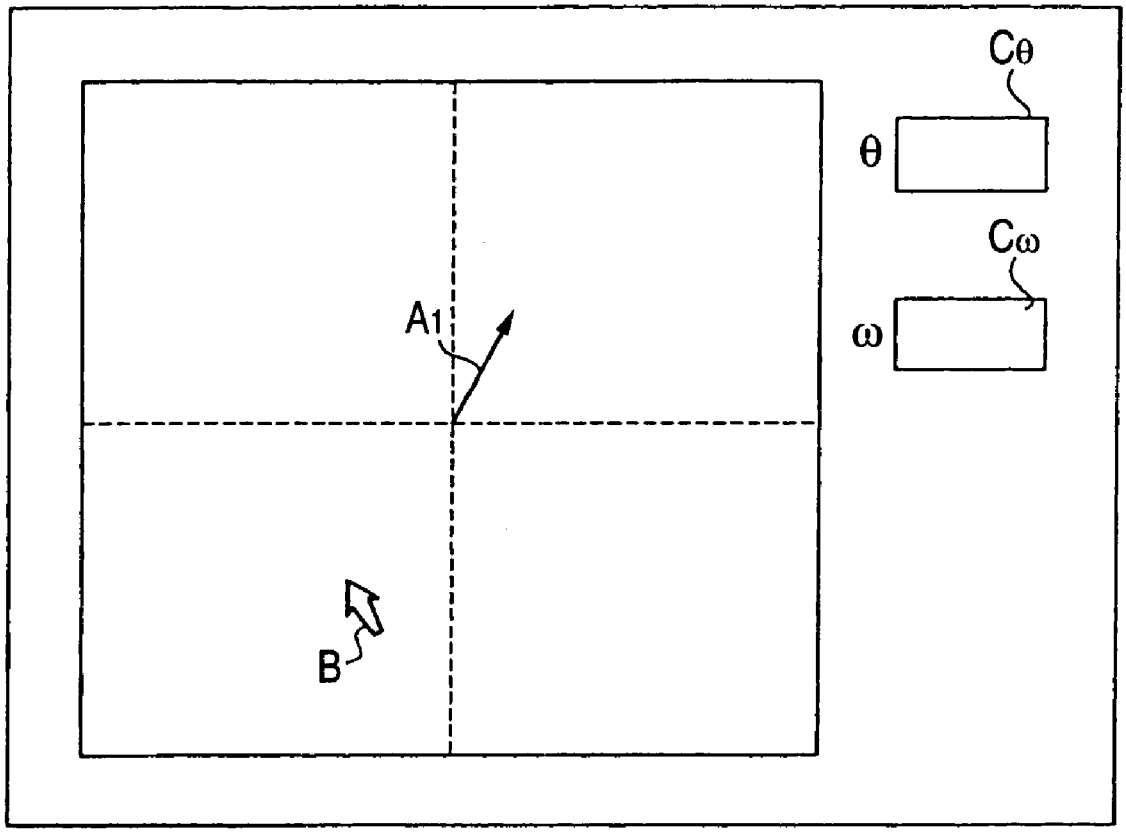
FIG. 4 is a diagram illustrating one example of a GUI in Operation Example 1 of the embodiment.

First, a description will be given of a case where the angle of rotation θ of the sound field is operated. The GUI in this case is shown in FIG. 4. In the drawing, the front of the listener L is set as θ=0, and θ increases as the sound field rotates clockwise. Reference character $A_1$ denotes a direction indicator, and indicates the frontal direction of a sound field desired by the listener L. As the listener L drags and drops this direction indicator $A_1$ by using a pointer B, the sound field can be rotated to a desired angle. A similar operation can be realized by entering a desired angle in a text box $C_\theta$. Furthermore, in a case where rotation is to be effected continuously at a uniform velocity, an angular velocity ω is entered in a text box $C_\omega$.

Figure 5:
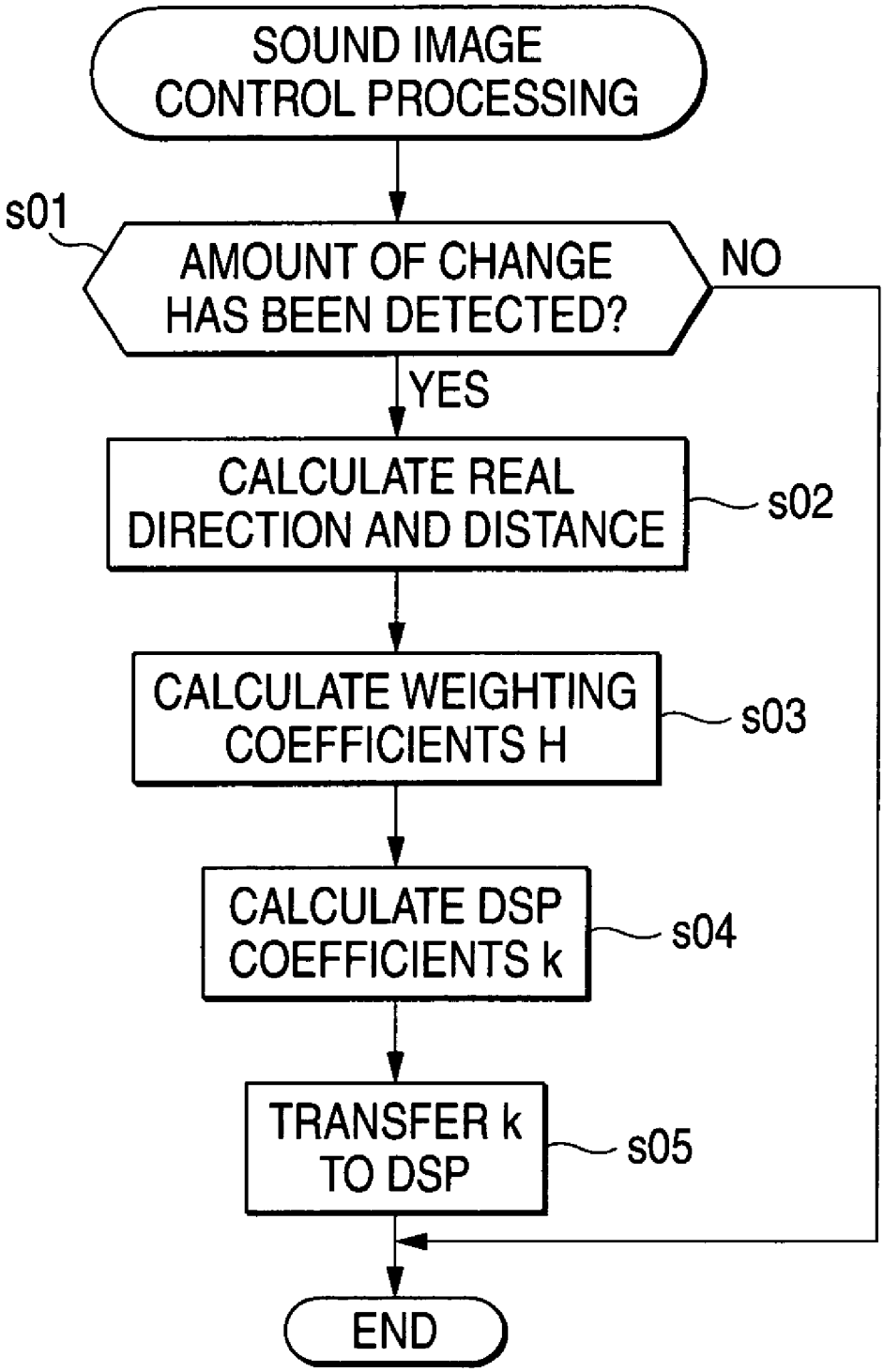
FIG. 5 is a diagram in which sound field control processing in the embodiment is shown in a flowchart.

The operation of processing in the case where the above-described input has been made can be expressed by a flowchart shown in FIG. 5. A description will be given hereafter with reference to FIG. 5.

First, when the reproduction of the sound field is started, a program for executing a series of processing shown in FIG. 5 is started. At this time, the CPU 11 monitors a change in the angle of rotation θ of the sound field inputted by the manipulator 4 (Step s01). If a change is recognized, the amount of change is detected, and the operation proceeds to Step s02, whereas if there is no change, processing ends.

In Step s02, the angle of rotation θ is calculated with respect to the amount of change detected in Step s01. In an ensuing Step s03, a weighting coefficient H is calculated on the basis of this result. The weighting coefficient H is determined from the speaker position information data file and the channel weighting table on the basis of the angle of rotation θ.

The speaker position information data file is a data file which describes the position information of the respective speakers and serves as basic data for this sound field control processing. By using this data, arithmetic processing for sound field control is effected, and the amount of movement of the sound field is calculated. For this reason, the speaker position information data file needs to be set in advance according to the speaker layout of the listening room where the sound field controller is used.

To describe the contents of the channel weighting table, this table describes sound pressure levels of the respective channels corresponding to the angles of rotation θ, i.e., weighting coefficients $H_{mn}(\theta)$ of the respective channels. These weighting coefficients $H_{mn}(\theta)$ are set according to the speaker position information in the aforementioned speaker position information data file. The channel weighting coefficients $H_{mn}(\theta)$ are values for setting the output levels of the respective speakers, and are each expressed by the function of the angle of rotation θ. Here, the index m indicates the input channel of the matrix mixer (see FIG. 3), and the index n indicates the output channel of the matrix mixer. In the case of a 5-channel reproducing system in which the speakers are arranged in the standard layout for both inputs and outputs, the correspondence between the output channels and the speakers $\mathbf{3}_L$, $\mathbf{3}_R$, $\mathbf{3}_{Ls}$, $\mathbf{3}_{Rs}$, and $\mathbf{3}_C$ is as follows.

Channel 1: speaker $\mathbf{3}_L$

Channel 2: speaker $\mathbf{3}_R$

Channel 3: speaker $\mathbf{3}_{Ls}$

Channel 4: speaker $\mathbf{3}_{Rs}$

Channel 5: speaker $\mathbf{3}_C$

Figure 6:
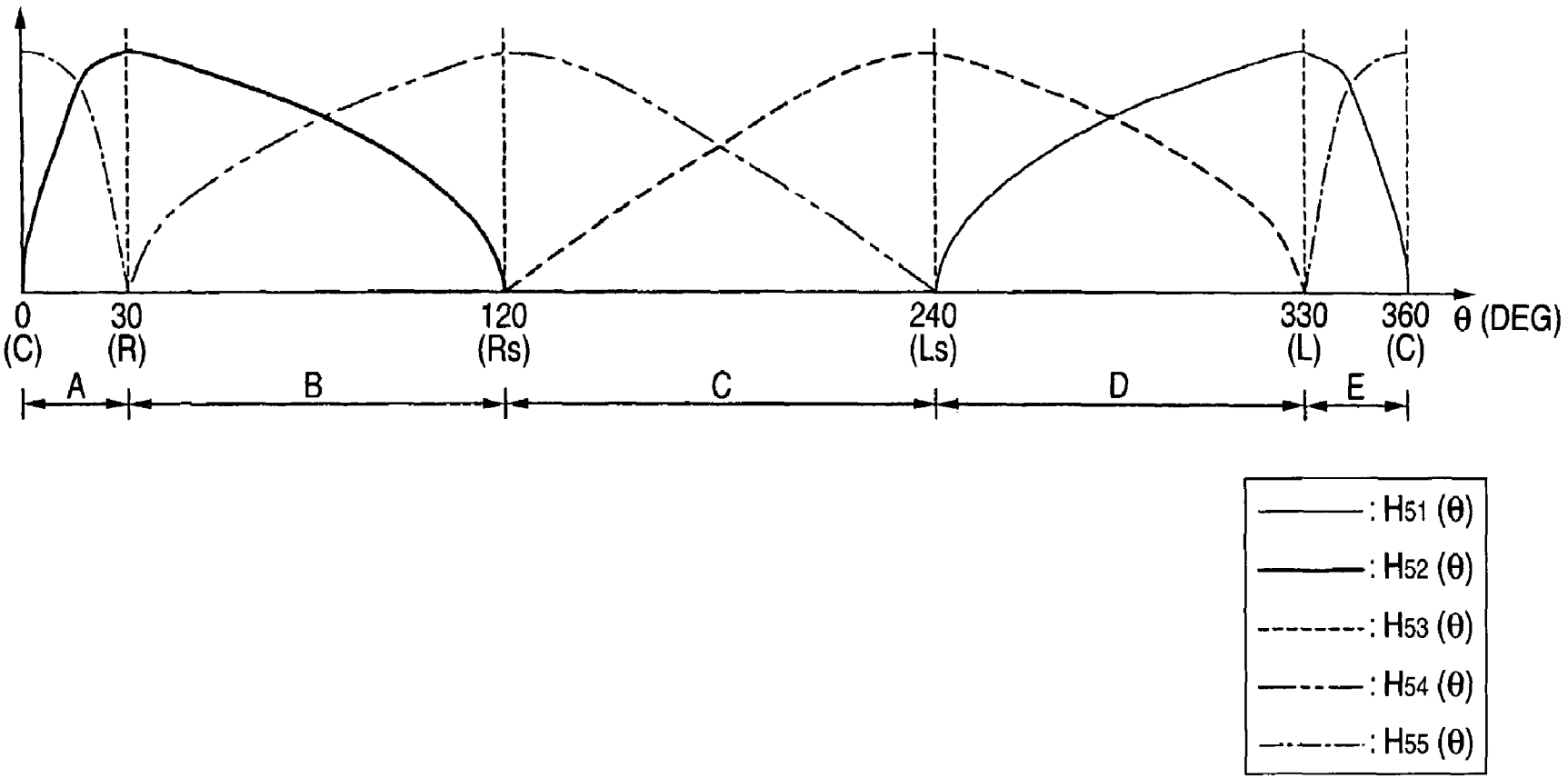
FIG. 6 is a diagram illustrating a channel weighting table in the embodiment.

As one example of the channel weighting coefficients $H_{mn}(\theta)$, the weighting coefficients $H_{51}(\theta)$, $H_{52}(\theta)$, $H_{53}(\theta)$, $H_{54}(\theta)$, and $H_{55}(\theta)$with respect to the input signal on channel 5 in the standard layout, if expressed by a graph, are shown in FIG. 6. In the three sections of A, C, and E, the output sound pressure level is expressed by a sinusoidal function, while in the two sections of B and D, the output sound pressure level is expressed by a square root function. The values of these weighting coefficients are values which are experientially derived so that the sound image will be naturally localized. The sound image is perceived as if speakers are generating sounds in the above-described manner in portions where the speakers are not present. This sound image is referred to as a virtual sound source (virtual speaker).

As is apparent from the drawing, when the sound field is rotated through an angle of rotation θ, the virtual speaker also rotates through the angle of rotation θ in conjunction with it. For the perception of that virtual speaker, two speakers adjacent to the position of that virtual speaker generate sounds. In a case where the angle of rotation θ is equal to the angle at which the speaker is installed (e.g., 30° in the case of the speaker $\mathbf{3}_R$), only the real speaker overlapping the position of the virtual speaker generates the sound.

Although the weighting coefficients $H_{mn}(\theta)$ with respect to the input signal on input channel 5 are shown in FIG. 6, the weighting coefficients $H_{mn}(\theta)$ whose output channels are identical, i.e., whose indices n are equal, are present in a number equal to the number of the input channels. All the waveforms of the respective coefficients are identical, but have phase differences equal to angular differences in the speaker layout. For example, in the case of the speaker layout conforming to the standard layout, a positional relationship which is expressed by Mathematical Formula 1 exists among $H_{11}(\theta)$, $H_{21}(\theta)$, $H_{31}(\theta)$, $H_{41}(\theta)$, and $H_{51}(\theta)$.

$$\begin{aligned} H_{51}(\theta) &= H_{11}(\theta + 30°) \\ &= H_{21}(\theta - 30°) \\ &= H_{31}(\theta + 120°) \\ &= H_{41}(\theta - 120°) \end{aligned}$$

Mathematical Formula 1

It should be noted that relationships corresponding to angular differences are similarly present with respect to the weighting coefficients for being outputted to the other respective speakers. Namely, Mathematical Formula 1, if generalized, can be expressed as shown in Mathematical Formula 2 in a case where where m=1, 2, 3, 4, and 5.

$$\begin{aligned} H_{5m}(\theta) &= H_{1m}(\theta + 30°) \\ &= H_{2m}(\theta - 30°) \\ &= H_{3m}(\theta + 120°) \\ &= H_{4m}(\theta - 120°) \end{aligned}$$

Mathematical Formula 2

In addition, the total sum of sound energy of the sound being generated must always be constant so that the virtual sound image shifts with a fixed volume when the virtual sound image smoothly moves on the circumference where the speakers are arranged. Since the sound energy is the square of the reproduction level, it suffices if the sum of squares of the reproduction level between adjacent output channels is fixed.

The channel weighting coefficients $H_{mn}(\theta)$ are set in view of the above-described matters. Referring to FIG. 6, in the section A, for example, $H_{52}(\theta)$ and $H_{55}(\theta)$ are expressed by Mathematical Formula 3, where the unit of θ is radian, and A is a constant.

$$H_{52}(\theta) = A \sin 3\theta$$

$$H_{55}(\theta) = A \cos 3\theta$$

Mathematical Formula 3

The sum of squares of $H_{52}(\theta)$ and $H_{55}(\theta)$ mentioned above is always fixed at $A^2$. Similarly, in the sections C and E as well, the sum of squares of these channel weighting coefficients is similarly fixed. As for the section B, $H_{52}(\theta)$ and $H_{54}(\theta)$ are expressed by Mathematical Formula 4, where the unit of θ is radian, and A is a constant.

$$H_{52}(\theta) = A\sqrt{1 - \frac{\theta - \pi/6}{\pi/2}}$$

$$H_{54}(\theta) = A\sqrt{1 - \frac{\theta - \pi/6}{\pi/2}}$$

Mathematical Formula 4

The sum of squares of $H_{52}(\theta)$ and $H_{54}(\theta)$ mentioned above is always fixed at $A^2$. Similarly, in the section D as well, the sum of squares of these channel weighting coefficients is similarly fixed.

Accordingly, in the channel weighting table expressed by FIG. 6, the sound energy is constant at all the angles of rotation θ.

In an ensuing Step s04, DSP coefficients k are determined on the basis of the weighting coefficients determined in Step s03. If it is assumed that the distance from a central point of a circle where the speaker is disposed to the circumference is R, and the distance from the central point of the circle where the speaker is disposed to the circumference where the virtual speaker is disposed is r, the DSP coefficients k are determined by Mathematical Formula 5, where m=1, 2, 3, 4, and 5, and $0 \leqq r \leqq R$.

$$k_{m1}=H_{m1}(\theta)*sqrt(r/R)$$

$$k_{m2}=H_{m2}(\theta)*sqrt(r/R)$$

$$k_{m3}=H_{m3}(\theta)*sqrt(r/R)+sqrt(1/3)*sqrt\{(R-r)/R\}$$

$$k_{m4}=H_{m4}(\theta)*sqrt(r/R)+sqrt(1/3)*sqrt\{(R-r)/R\}$$

$$k_{m5}=H_{m5}(\theta)*sqrt(r/R)+sqrt(1/3)*sqrt\{(R-r)/R\}$$ Mathematical Formula 5

In Mathematical Formula 5, the first term is a value which is derived on the basis of the reproduction level for localizing the sound image on the circumference where the speaker is disposed, and the greater the distance r, the larger this value. In addition, the second term is a value which is derived on the basis of the reproduction level for localizing the sound image at the listening position where the listener L is located, and the greater the distance r, the smaller this value. As these terms change according to the distance r, it is possible to obtain a sense of distance of the virtual sound source.

However, in this example of operation, since the distance r=R, Mathematical Formula 6 holds. It should be noted that, in Mathematical Formula 6, m=1, 2, 3, 4, and 5, and n=1, 2, 3, 4, and 5.

$$k_{mn}=H_{mn}(\theta)$$ Mathematical Formula 6

After the DSP coefficients k are determined from the above Mathematical Formula 6, in an ensuing Step s05, these DSP coefficients k are transferred to the DSP 172.

The DSP coefficients k are transferred to the DSP 172 through the above-described processing, and desired sound field control is realized by effecting signal processing by the signal processing unit 17 by using these DSP coefficients k.

A description will be give below of the operation which is obtained by the above-described processing with respect to the input of the angles of rotation θ.

If attention is focused on the input signal on channel 5 alone, sound image control in a case where there are no displacements in the center of rotation (X, Y) and the distance r from the central point is realized by generation of the sound from two speakers adjacent to the virtual speaker located at a point which moved by the angle of rotation θ from the speaker $\mathbf{3}_C$. For example, if the displacement of θ is 30°<θ<120°, it is the two speakers $\mathbf{3}_R$ and $\mathbf{3}_{RS}$ that generate the sound at this time. The reproduction levels of the aforementioned two speakers $\mathbf{3}_R$ and $\mathbf{3}_{RS}$ change according to the curves shown in FIG. 6. Further, in a case where the position of the virtual speaker overlaps any one of the real speakers, only that real speaker generates the sound.

Namely, in a case where inputs of functions $f_1(t)$, $f_2(t)$, $f_3(t)$, $f_4(t)$, and $f_5(t)$ have been made from all the input channels 1, 2, 3, 4, and 5, an output $f_C(t)$ from the speaker $\mathbf{3}_C$ is expressed by Mathematical Formula 7.

$$f_C(t)=H_{15}(\theta)f_1(t)+H_{25}(\theta)f_2(t)+H_{35}(\theta)f_3(t)+H_{45}(\theta)f_4(t)+H5_{15}(\theta)f_5(t)$$ Mathematical Formula 7

However, three or four of the weighting coefficients $H_{mn}(\theta)$ in the above Mathematical Formula 7 are 0.

Since the same holds true of the other speakers, the outputs $f_L(t)$, $f_R(t)$, $f_{Ls}(t)$, $f_{Rs}(t)$, and $f_C(t)$ from the respective speakers are expressed by Mathematical Formula 8.

$$\begin{pmatrix} f_L(t) \\ f_R(t) \\ f_{Ls}(t) \\ f_{Rs}(t) \\ f_C(t) \end{pmatrix} = \begin{pmatrix} H_{11}(\theta) & H_{21}(\theta) & H_{31}(\theta) & H_{41}(\theta) & H_{51}(\theta) \\ H_{12}(\theta) & H_{22}(\theta) & H_{32}(\theta) & H_{42}(\theta) & H_{52}(\theta) \\ H_{13}(\theta) & H_{23}(\theta) & H_{33}(\theta) & H_{43}(\theta) & H_{53}(\theta) \\ H_{14}(\theta) & H_{24}(\theta) & H_{34}(\theta) & H_{44}(\theta) & H_{54}(\theta) \\ H_{15}(\theta) & H_{25}(\theta) & H_{35}(\theta) & H_{45}(\theta) & H_{55}(\theta) \end{pmatrix} \begin{pmatrix} f_1(t) \\ f_2(t) \\ f_3(t) \\ f_4(t) \\ f_5(t) \end{pmatrix}$$ Mathematical Formula 8

In Mathematical Formula 8 as well, three or four of the five weighting coefficients $H_{mn}(\theta)$ in the respective expressions of $f_L(t)$, $f_R(t)$, $f_{Ls}(t)$, $f_{Rs}(t)$, and $f_C(t)$ are 0 in the same way as Mathematical Formula 7.

Next, a description will be given of the sound effect which is realized by this example of operation.

Figure 7:
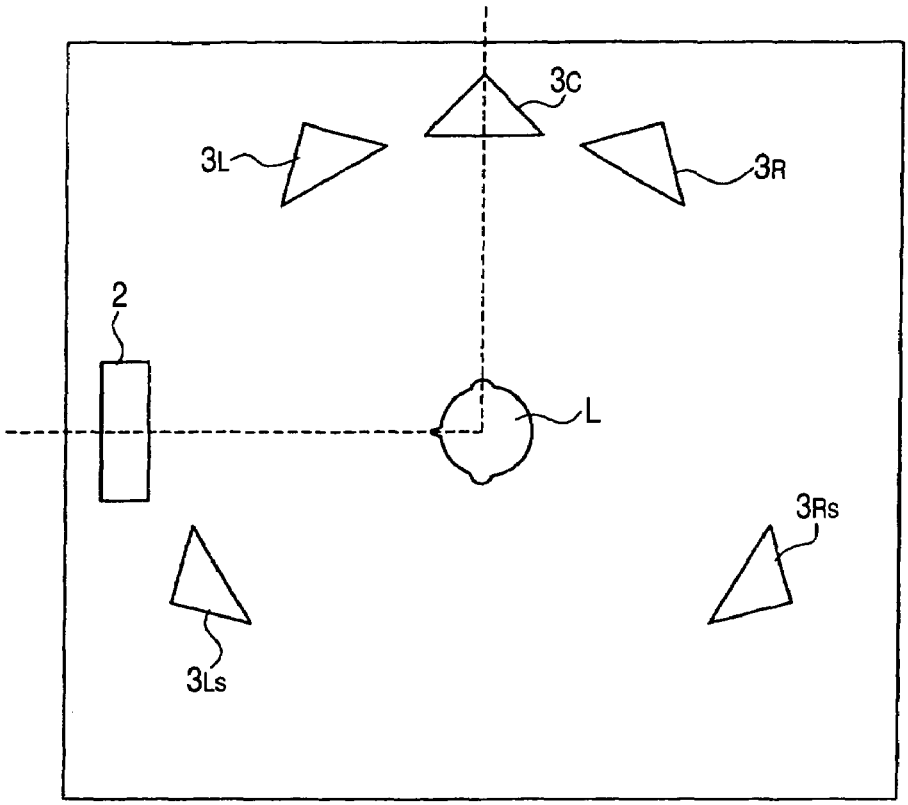
FIG. 7 is a diagram illustrating the effect of sound field correction in Operation Example 1 of the embodiment.

As the effect of this example of operation, it is possible to cite the effect of correction of the sound field. For example, in a case where the orientations of the speaker in the central direction and the display unit 2 does not coincide, as shown in FIG. 7, if the surround sources as they are are reproduced, a discrepancy occurs between the sound image and the sound field which are reproduced. In such a case, if the rotation of the sound field shown in this example of rotation is applied, it is possible to listen as if the sound of the center channel is being generated from the front of the display unit 2 at whichever position the display unit 2 is located.

In addition, in the case of listening to music which is not accompanied with picture, the listener L can hear as if the speaker in the central direction is present in front of himself or herself whichever direction he or she faces. This rotation processing of the sound image can, of course, be operated manually. However, if a seat where the listener L sits is provided with a means for detecting the rotation, and an angle of rotation θ corresponding to the angle of rotation of that chair is arranged to be inputted to this sound field controller 1, it is possible to automatically rotate the sound field according to a change in the direction of the listener.

In addition, if the processing of this example of rotation is applied to existing surround sources, a sound effect rich in presence can be imparted by the picture of such as a movie. For example, it is assumed that there was a scene in which the picture from a visual point of a person is being shown on a monitor, and that person suddenly turns around. At this time, if this example of operation is applied, the position of the listener L does not change, and only the surrounding sound field rotates, so that the listener L can physically feel a sound field similar to that of the person in the picture. In this case, an arrangement needs to be provided such that a signal indicating the angle of rotation θ is outputted from the recording medium, such as a DVD for outputting the video signal, synchronously with the picture.

If similar processing is effected for the other speakers, the output signal from each channel becomes the sum of input signals on the plurality of channels. For example, in a case where inputs respectively expressed by functions $f_1(t)$, $f_2(t)$, $f_3(t)$, $f_4(t)$, and $f_5(t)$ have been made from all the input channels 1, 2, 3, 4, and 5, outputs $f_L(t)$, $f_R(t)$, $f_{Ls}(t)$, $f_{Rs}(t)$, and $f_C(t)$ from the speakers $\mathbf{3}_L$, $\mathbf{3}_R$, $\mathbf{3}_{Ls}$, $\mathbf{3}_{Rs}$, and $\mathbf{3}_C$ are expressed by Mathematical Formula 9, where α=sqrt (r/R), and β=sqrt {(R−r)/3R}.

$$\begin{pmatrix} f_L(t) \\ f_R(t) \\ f_{Ls}(t) \\ f_{Rs}(t) \\ f_C(t) \end{pmatrix} = \begin{pmatrix} H_{11}(\theta)\alpha & 0 & 0 & 0 & 0 \\ 0 & H_{22}(\theta)\alpha & 0 & 0 & 0 \\ \beta & \beta & H_{33}(\theta)\alpha+\beta & \beta & \beta \\ \beta & \beta & \beta & H_{44}(\theta)\alpha+\beta & \beta \\ \beta & \beta & \beta & \beta & H_{55}(\theta)\alpha+\beta \end{pmatrix} \begin{pmatrix} f_1(t) \\ f_2(t) \\ f_3(t) \\ f_4(t) \\ f_5(t) \end{pmatrix}$$

Mathematical Formula 9

It should be noted that, as described in the description of FIG. 4, it is possible to provide a means for inputting the angular velocity ω. This is convenient in cases where the angle of rotation θ is continuously outputted for a fixed period of time. Since the angular velocity ω is a time differential dθ/dt of the angle of rotation θ, the angular velocity ω as an input value can be treated equivalently to the angle of rotation θ. In this case, the CPU sequentially computes the angle of rotation θ on the basis of the given angular velocity ω.

OPERATION EXAMPLE 2

Enlargement and Reduction of Sound Field

Figure 9:
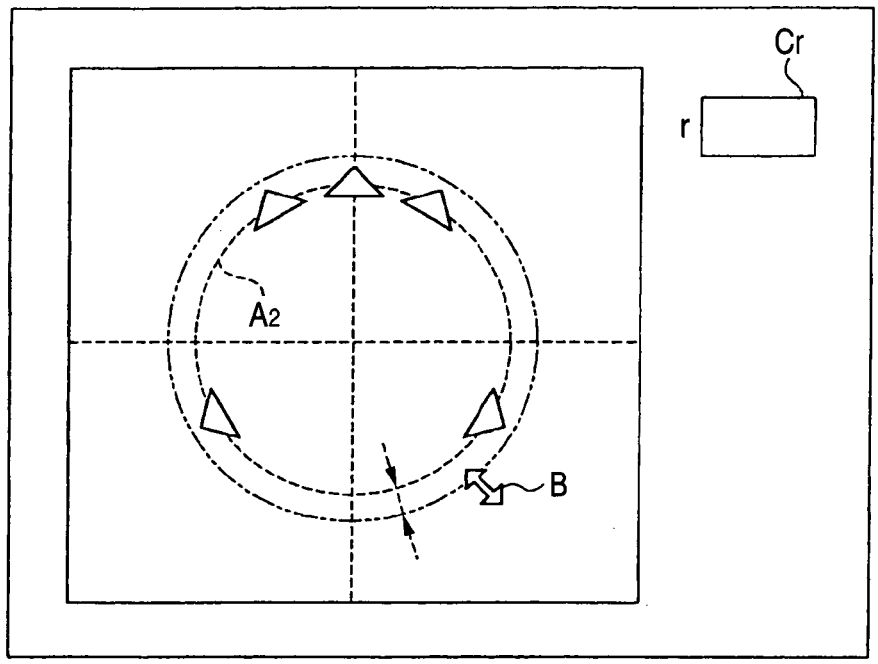
FIG. 9 is a diagram illustrating one example of the GUI in Operation Example 2 of the embodiment.

Next, a description will be given of a case where the sound sources, which are arranged on the circumference at a distance R from the central point of the circle where the speakers are arranged, are virtually moved to a distance r from the central point, i.e., a case where the sound field is enlarged or reduced. The GUI in this case is shown in FIG. 9. In the drawing, the position of the listener L is set to r=0, and a speaker position indicator $A_2$ changes its size about the position of the listener L. The input of the amount of change is made by dragging and dropping the speaker position indicator $A_2$ by means of the pointer B or by entering a desired value of r in a text box $C_r$.

In the same way as Operation Example 1, the operation in this case is carried out in accordance with the flowchart shown in FIG. 5. For this reason, the description of the operation in accordance with the flowchart will be omitted. Hereafter, a description will be given of the operation which is obtained by processing with respect to the input of the distance r from the central point.

If attention is focused on the signal on input channel 5 alone, in a case where there are no displacements in the center of rotation (X, Y) and the angle of rotation θ, the sound image control of the virtual speakers located at points at the distance r from the position of the listener L is realized as follows.

First, the case of 0≦r≦R is considered. At this time, the DSP coefficients are determined in accordance with Mathematical Formula 5. In addition, since θ=0°, the weighting coefficient which is not 0 is only $H_{nn}(\theta)$ in terms of input and output channels n, and in this case it is only $H_{55}(\theta)$. Therefore, the DSP coefficients which are not 0 are $k_{53}$, $k_{54}$, and $k_{54}$. Accordingly, the speakers which are caused to generate sound are the speakers $\mathbf{3}_C$, $\mathbf{3}_{Rs}$, and $\mathbf{3}_{Ls}$.

Next, a description will be given of the case of r>R. In this case, the DSP coefficient is given by Mathematical Formula 10, where m=1, 2, 3, 4, and 5, and n=1, 2, 3, 4, and 5.

$$k_{mn}=H_{mn}(\theta)*(R/r)^2$$

Mathematical Formula 10

In reality, however, three or four of the five values of the weighting coefficients $H_{mn}(\theta)$ expressed by the above Mathematical Formula 10 and having equal n are 0 in each case, so that for each output channel there are one or two DSP coefficients k which are not 0. Namely, the speakers which generate the sound are one real speaker located on a straight line connecting the virtual speaker and the central point or two real speakers adjacent to that straight line. Accordingly, Mathematical Formula 11 holds.

$$\begin{pmatrix} f_L(t) \\ f_R(t) \\ f_{Ls}(t) \\ f_{Rs}(t) \\ f_C(t) \end{pmatrix} = \left(\frac{R}{r}\right)^2 * \begin{pmatrix} H_{11}(\theta) & H_{21}(\theta) & H_{31}(\theta) & H_{41}(\theta) & H_{51}(\theta) \\ H_{12}(\theta) & H_{22}(\theta) & H_{32}(\theta) & H_{42}(\theta) & H_{52}(\theta) \\ H_{13}(\theta) & H_{23}(\theta) & H_{33}(\theta) & H_{43}(\theta) & H_{53}(\theta) \\ H_{14}(\theta) & H_{24}(\theta) & H_{34}(\theta) & H_{44}(\theta) & H_{54}(\theta) \\ H_{15}(\theta) & H_{25}(\theta) & H_{35}(\theta) & H_{45}(\theta) & H_{55}(\theta) \end{pmatrix} \begin{pmatrix} f_1(t) \\ f_2(t) \\ f_3(t) \\ f_4(t) \\ f_5(t) \end{pmatrix}$$

Mathematical Formula 11

However, three or four of the five weighting coefficients $H_{mn}(\theta)$ in the respective expressions of $f_L(t)$, $f_R(t)$, $f_{Ls}(t)$, $f_{Rs}(t)$ and $f_C(t)$ are 0.

Furthermore, the case of r=0 is a state in which the sound source is perceived as if it is localized at the position of the listener L. The DSP coefficients $k_{mn}$ at this time are determined from Mathematical Formula 5, but since r=0, the first term becomes 0 in each case. Accordingly, the DSP coefficients which are positive are $k_{m3}$, $k_{m4}$, and $k_{m5}$, and their values are sqrt(1/3), respectively. Hence, Mathematical Formula 12 holds if it is assumed that input signals to the respective speakers are $f_1(t)$, $f_2(t)$, $f_3(t)$, $f_4(t)$, and $f_5(t)$, and outputs from the speakers $\mathbf{3}_L$, $\mathbf{3}_R$, $\mathbf{3}_{Ls}$, $\mathbf{3}_{Rs}$, and $\mathbf{3}_C$ are $f_L(t)$, $f_R(t)$, $f_{Ls}(t)$, $f_{Rs}(t)$, and $f_C(t)$.

$$\begin{pmatrix} f_L(t) \\ f_R(t) \\ f_{Ls}(t) \\ f_{Rs}(t) \\ f_C(t) \end{pmatrix} = \sqrt{\frac{1}{3}} * \begin{pmatrix} 0 & 0 & 0 & 0 & 0 \\ 0 & 0 & 0 & 0 & 0 \\ 1 & 1 & 1 & 1 & 1 \\ 1 & 1 & 1 & 1 & 1 \\ 1 & 1 & 1 & 1 & 1 \end{pmatrix} \begin{pmatrix} f_1(t) \\ f_2(t) \\ f_3(t) \\ f_4(t) \\ f_5(t) \end{pmatrix} \quad \text{Mathematical Formula 12}$$

Namely, all the sounds are generated from the three speakers $\mathbf{3}_C$, $\mathbf{3}_{Ls}$, and $\mathbf{3}_{Rs}$ at equal reproduction levels, respectively.

The sound effect according to this example of operation will be shown below.

Figure 8:
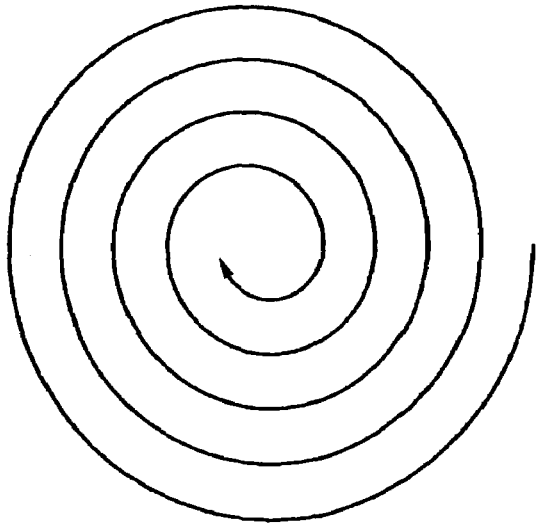
FIG. 8 is a diagram illustrating sound field control in Operation Example 2 of the embodiment.

If this example of operation is applied to existing surround sources, it becomes possible to control the depth perception of the sound field. In addition, if this example of operation and the above-described Operation Example 1 are jointly used, sound field control such as the one shown by a locus shown in FIG. 8 becomes possible. Namely, the drawing shows that a sound effect is imparted such that an object generating a sound is approaching while swirling around the listener L located in the center.

OPERATION EXAMPLE 3

Movement of Sound Field

Figure 10:
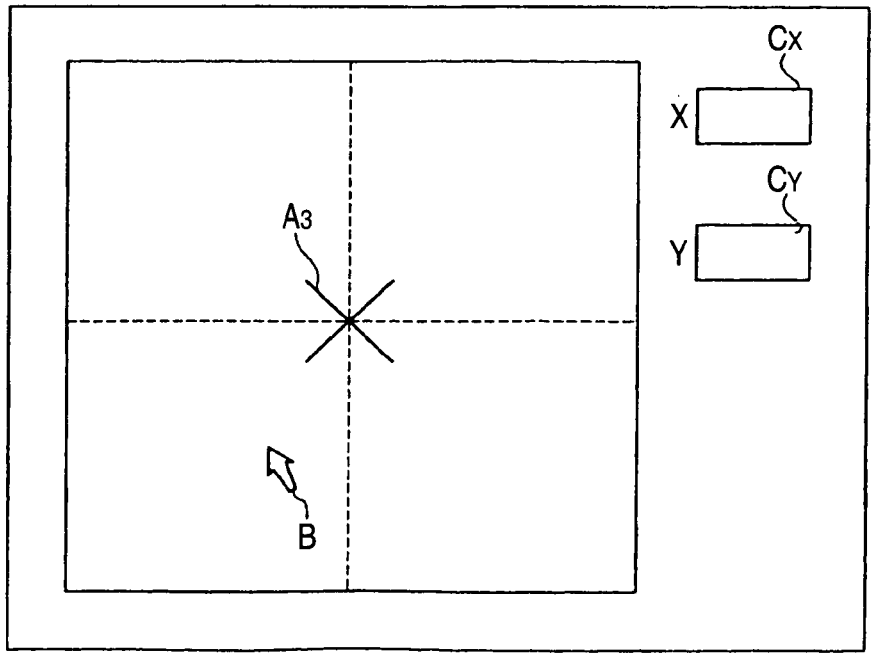
FIG. 10 is a diagram illustrating one example of the GUI in Operation Example 3 of the embodiment.

Here, a description will be given of a case where the sound field is moved by moving the central point (X, Y) of the sound field while retaining the positional relationship of the entire sound field. The GUI in this case is shown in FIG. 10. In the drawing, the position of the listener L is set to X=0 and Y=0. The input of the amount of change is made by dragging and dropping a sound field position indicator $A_3$ by means of the pointer B or by entering desired values of X and Y in text boxes $C_X$ and $C_Y$.

Figure 11:
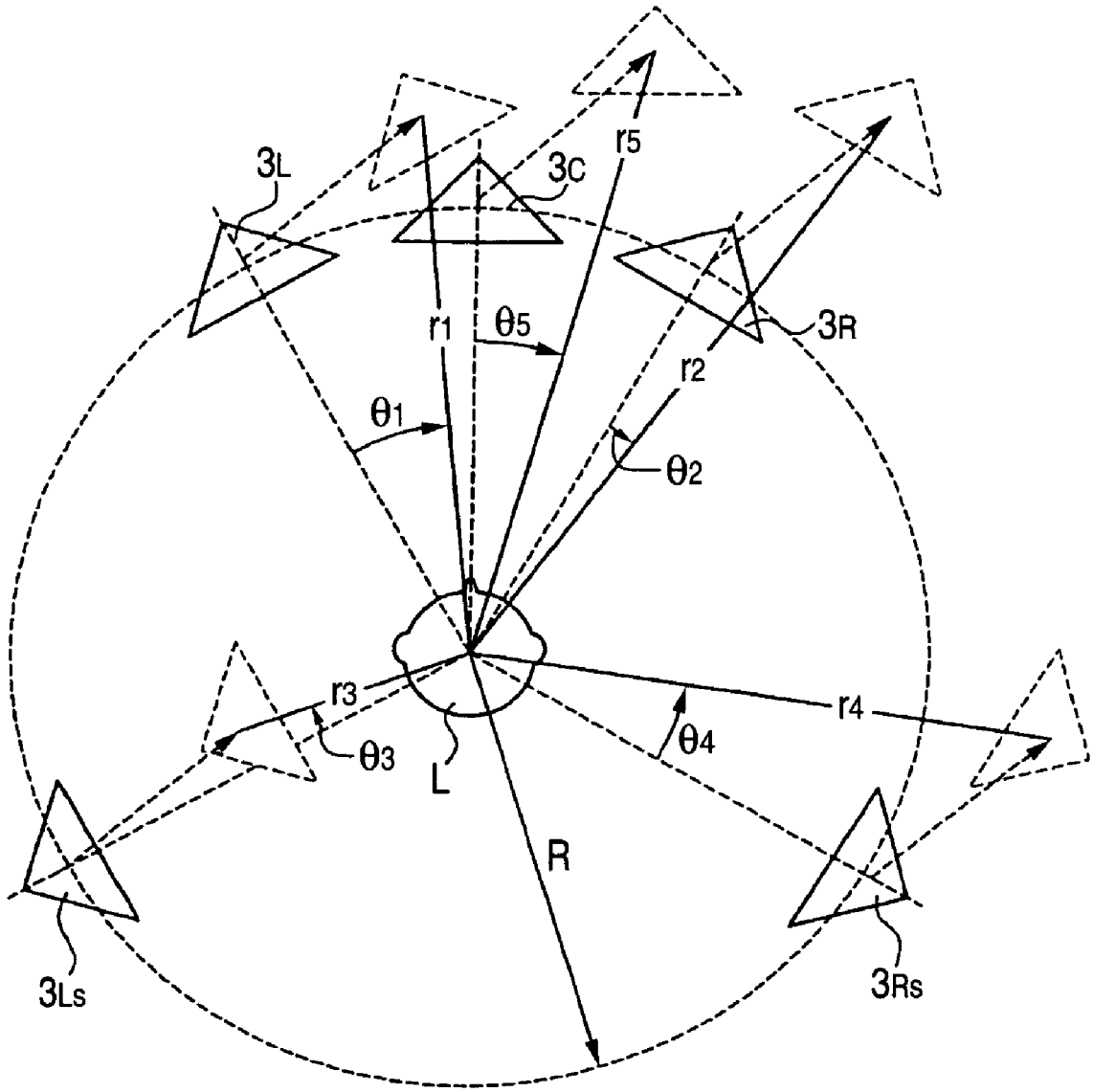
FIG. 11 is a diagram illustrating the movement of a sound image in Operation Example 3 of the embodiment.

In the case where the central point (X, Y) of the sound field is moved, if attention is focused on the respective virtual speakers, it is apparent that this movement can be expressed by the synthesis of the rotation of the sound image and the change of the distance from the central point (see FIG. 11). Accordingly, Mathematical Formula 5 holds in the case of $0 \leqq r \leqq R$, and Mathematical Formula 10 holds in the case of $r > R$.

Here, this operation differs from the above-described Operation Examples 1 and 2 in that r and θ are different for each virtual speaker. Therefore, if $r_1$, $\mathbf{4}_2$, $\mathbf{4}_3$, $r_4$, and $r_5$ and $\theta_1$, $\theta_2$, $\theta_3$, $\theta_4$, and $\theta_5$ are determined as shown in FIG. 11, the DSP coefficients in this case can be expressed by Mathematical Formula 13 in the case of $0 \leqq r \leqq R$, and by Mathematical Formula 14 in the case of $r > R$. It should be noted that, in Mathematical Formulas 13 and 14, m=1, 2, 3, 4, and 5, and n=1, 2, 3, 4, and 5.

$$k_{m1} = H_{m1}(\theta_m) * sqrt(r_m/R)$$

$$k_{m2} = H_{m2}(\theta_m) * sqrt(r_m/R)$$

$$k_{m3} = H_{m3}(\theta_m) * sqrt(r_m/R) + sqrt(1/3) * sqrt\{(R - r_m)/R\}$$

$$k_{m4} = H_{m4}(\theta_m) * sqrt(r_m/R) + sqrt(1/3) * sqrt\{(R - r_m)/R\}$$

$$k_{m5} = H_{m5}(\theta_m) * sqrt(r_m/R) + sqrt(1/3) * sqrt\{(R - r_m)/R\} \quad \text{Mathematical Formula 13}$$

$$k_{mn} = H_{mn}(\theta_m) * (R/r_m)^2 \quad \text{Mathematical Formula 14}$$

As the input signals are converted according to the DSP coefficients determined as described above, desired sound field control is realized.

Next, a description will be given of the sound effect which is realized by this example of operation.

Figure 12:
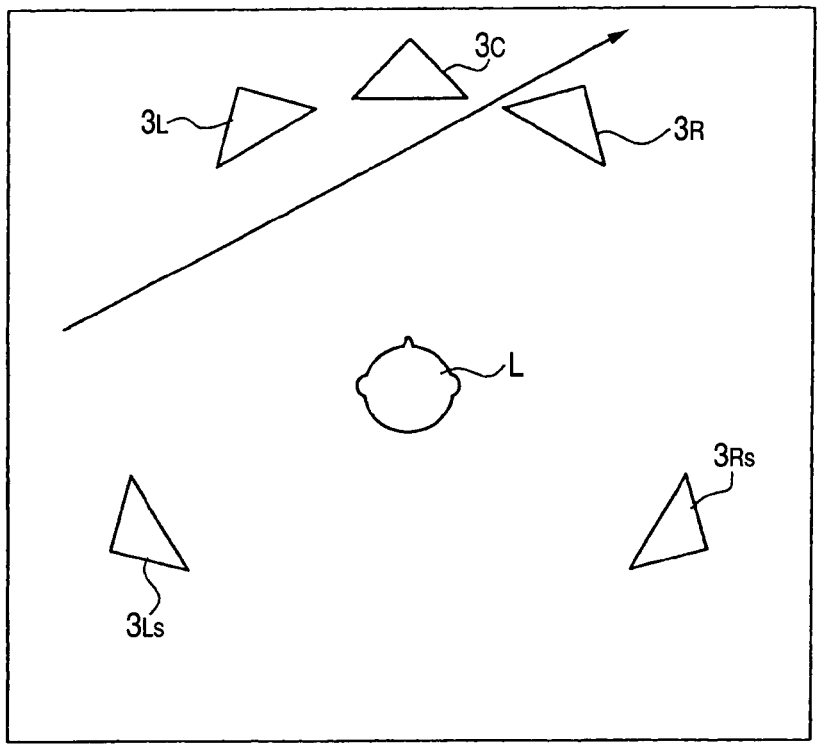
FIG. 12 is a diagram illustrating one example of the locus of sound field movement which is realized by the example of operation of the embodiment.

FIG. 12 shows one example of the locus of the sound field movement which is realized by this example of operation. If the sound field moves as shown in the drawing, the listener L is capable of feeling as if the listener L himself or herself diagonally traverses the space having this sound field.

Figure 13:
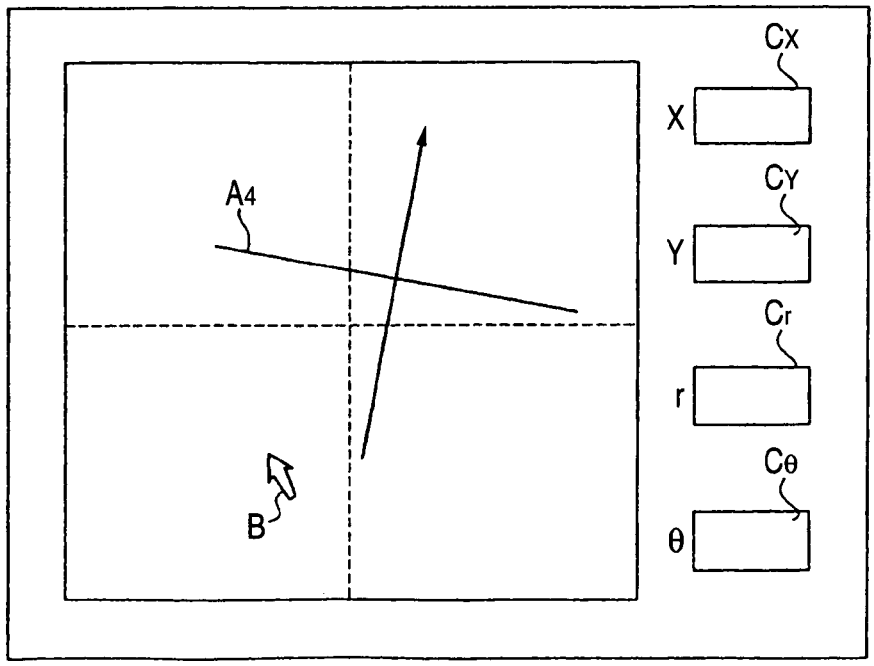
FIG. 13 is a diagram illustrating one example of the GUI in the embodiment.

Although three kinds of operation example have been described above, in this embodiment these operations can be implemented by a single apparatus and a single interface. For example, the GUI suffices if it is such as the one shown in FIG. 13.

<Modification>

It should be noted that this invention may be carried out in the following form.

In the above-described embodiment, so-called real-time control is carried out in which when the operation is inputted by the listener L using the sound field controller body 1 by means of the manipulator 4, the sound field is localized in a desired position in real time. In the invention, however, it is also possible to carry out program control in which processing is executed by programming in advance such that the sound field depicts a certain locus with the lapse of time. Namely, the CPU 11 consecutively computes θ, r, X, and Y according to the program, and it is possible to provide sound field control on the basis of it.

Figure 14A:
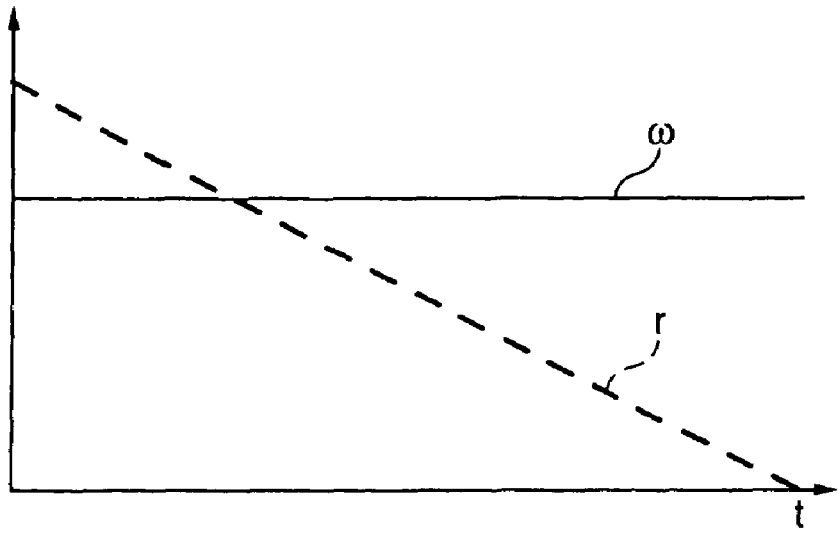
FIGS. 14A and 14B are diagrams illustrating changes in respective amounts of change through program control in a modification of the invention.
Figure 14B:
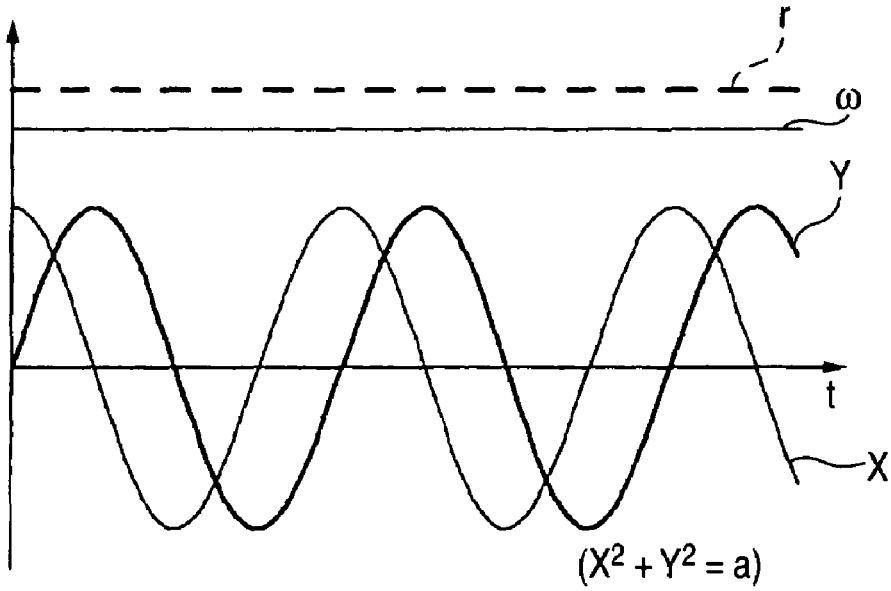
Figure 15A:
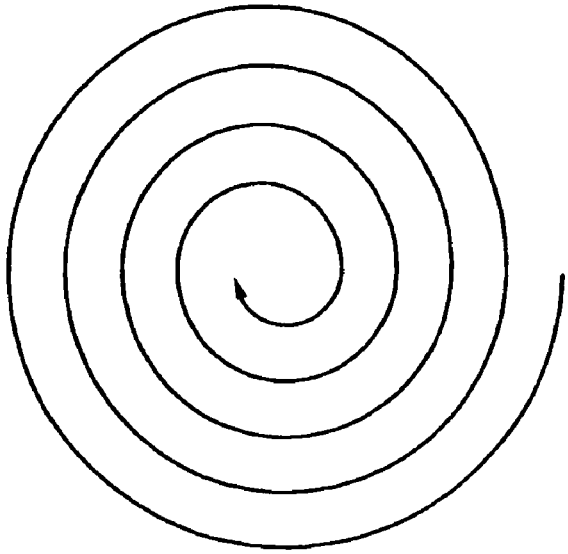
FIGS. 15A and 15B are diagrams illustrating loci of sound field movement which is realized by the modification of the embodiment.
Figure 15B:
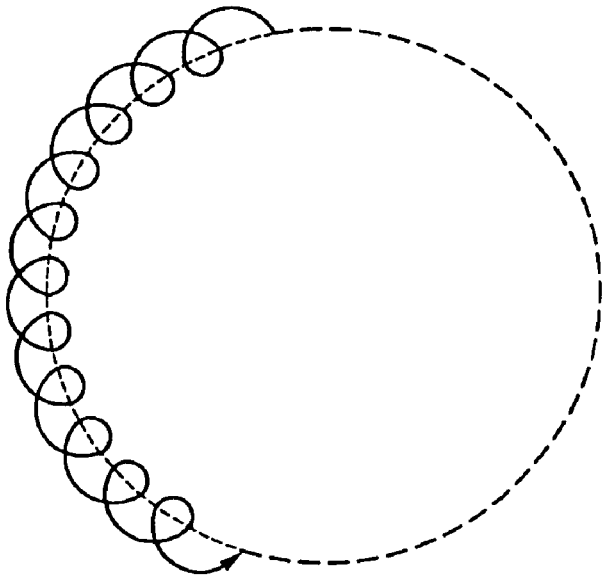

As an example of the above-described program control, FIGS. 14A and 14B show through graphs examples in which the distance r and the angular velocity ω change with the lapse of time t. Further, loci of the sound field movement which is realized by performing such processing are illustrated in FIGS. 15A and 15B. FIGS. 14A and 15A show the locus where the sound field approaches while rotating about the listener L. This locus is realized by gradually decreasing the distance r from the center while maintaining the angular velocity ω to a fixed value which is not 0. FIGS. 14B and 15B show the locus where the sound field revolves around the listener L while the sound field itself rotates. This locus is realized by setting the angular velocity ω to a fixed value which is not 0, while causing the central point of the sound field rotation to rotate at an equal distance from the listener L. At this time, since the central point (X, Y) of the sound field rotation depicts a circle, it suffices if X and Y are a sine wave and a cosine wave of the same phase, respectively.

Furthermore, in each of the above-described program mode, it is possible to adopt a method in which a number of loci are prepared in advance as modes, the listener L selects a desired mode, and the sound is reproduced according to the selected mode.

In addition, data such as θ, r, X, and Y corresponding to graphic and acoustic data recorded in a recording medium such as a DVD may be recorded in advance in the recording medium, and as the sound field controller reads the data, it is also possible to output the sound by adding the above-described various sound effects to the reproduced sound.

In addition, the speaker position information data file may employ specifications in which a plurality of items of position information are described, or may employ specifications in which only a single item of position is described and is rewritten when a change has been made in the speaker position. Further, to simplify the configuration of the sound field controller in accordance with the invention, it is possible to adopt a configuration in which this speaker position information data file is excluded. In this case, the use of the sound field controller is set as a precondition. For example, it suffices if a speaker layout based on the recommended layout of ITU-R BS.775-1 set forth by the International Telecommunication Union (ITU) is set as a system requirement of this sound field controller. By so doing, even if the sound field controller is not provided with the speaker position information data file, the channel weighting table is prepared on the basis of the recommended layout.

In addition, although in the above-described embodiment the plurality of speakers are arranged on an identical circumference, the speaker layout is not limited to the same. The invention is applicable to various speaker layouts insofar as appropriate speaker position information data files and channel weighting tables can be obtained according to the speaker layouts.

Figure 16:
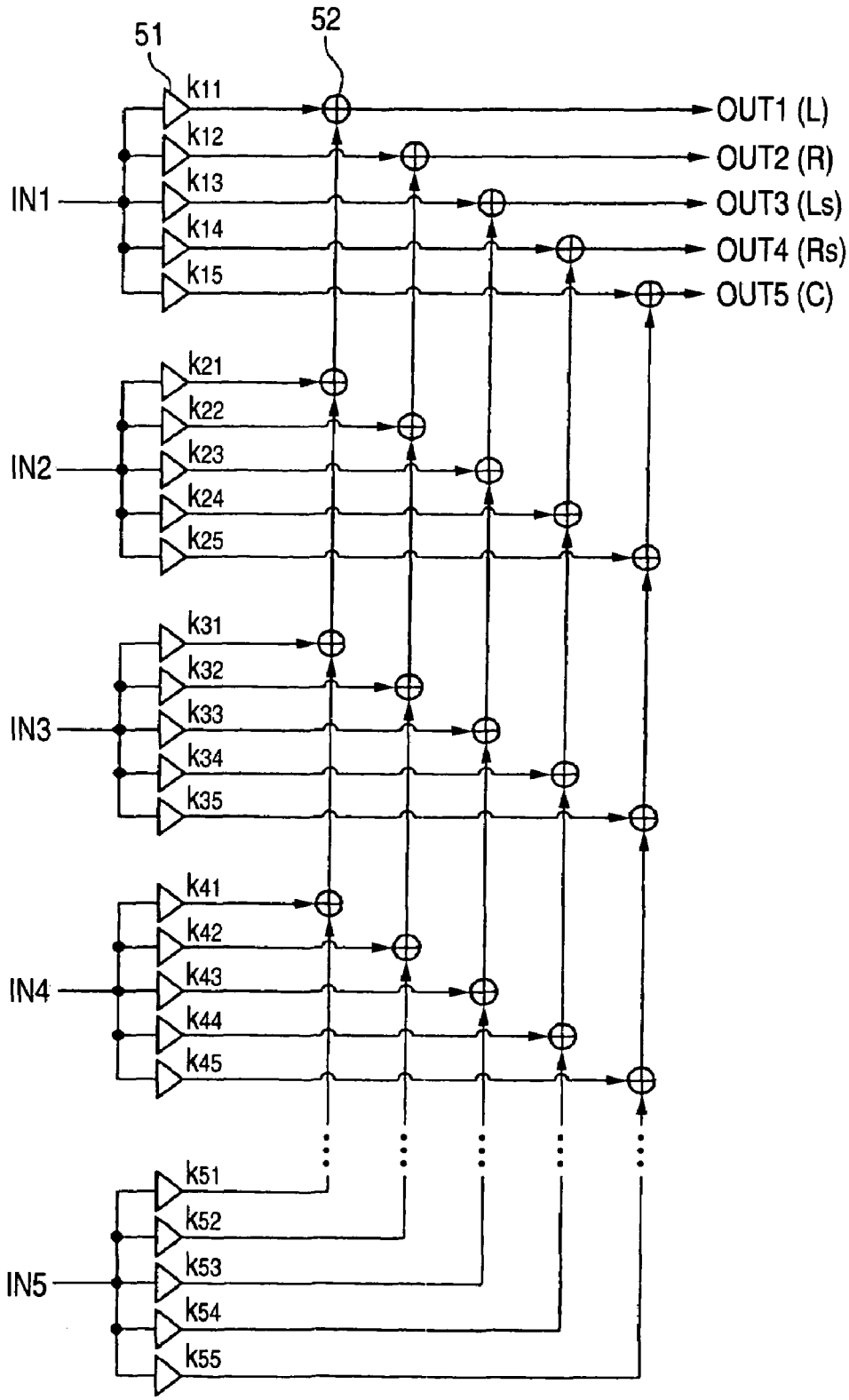
FIG. 16 is a diagram illustrating a modified example of the matrix mixer in the embodiment.

In addition, since the matrix mixer is realized by the product-sum operation of the number of input channels and the number of output channels, sound field control is possible even if the number of input channels and the number of output channels differ. FIG. 16 shows one such example. In FIG. 16, although the number of input channels is N, it is, of course, possible to set the number of output channels to an arbitrary numerical value of 2 or more. As the number of input channels N, it is possible to set an arbitrary numerical value of 1 or more.

In addition, the GUI described in the foregoing embodiment shows a relative positional relationship between the listener and the speakers. Therefore, the above-described GUI is an input means for virtually moving the speakers by using the listener as a reference; however, the GUI may be arranged as an input means for allowing the listener to virtually move in the sound field by using the speaker position as reference.

In addition, the above-described series of functions can, of course, be realized by a general-purpose computer. Further, the programs and data stored in the ROM 12 and the HDD 14 may be stored in another recording medium (e.g., a floppy disk, a CD-ROM, and the like), and may be made available for use by a general-purpose computer.

As described above, in accordance with the invention, it is possible to realize the sound field control of surround sources of the multi-channel reproducing system.

What is claimed is:

1. A sound field controller including a plurality of output channels for respectively supplying signals to a plurality of speakers, comprising:

a weighting-coefficient outputting unit which outputs weighting coefficients for determining how the signals on the plurality of channels for reproducing a sound field are to be distributed to the output channels, according to a relative positional relationship between the sound field and a listener;

an input unit which inputs positional relation data indicating the relative positional relationship; and a distribution controller which distributes the signals on the plurality of channels to the output channels on the basis of the outputted weighting coefficients according to the inputted positional relation data, wherein the speakers are disposed on a predetermined circumference located around a listener and a distance from a central point of a circle where the speakers are disposed to the predetermined circumference is R, and a distance from the central point of the circle to a virtual circumference where virtual speakers are disposed is r, the virtual speakers being located at virtual positions where the sound image is perceived to be if a direction indicator of the listener has been modified, and if $0<r<R$, a first term, which is a value derived on the basis of the weighting conditions output from the weighting-coefficient outputting unit and a reproduction level for localizing the sound image on the circumference where the speakers are disposed, and a second term, which is a value derived based on the reproduction level for localizing the listening position where the listener is located, are added to generate coefficients (DSP coefficients), and the distribution controller distributes the signal on the plurality of channels to the output channels on the basis of the generated coefficients, and if $r>R$, coefficients (DSP coefficients) are generated by multiplying the weighting coefficients output from the weighting-coefficient outputting unit by $(R/r)^2$ and the distribution controller distributes the signal on the plurality of channels to the output channels on the basis of the generated coefficient.

2. The sound field controller according to claim 1, wherein the positional relation data includes information indicating an angle of offset of the sound field from an axis directed toward one of the speakers.

3. The sound field controller according to claim 1, further comprising a positional-relation computing unit which prepares the positional relation data on the basis of a predetermined function, the positional-relation computing unit being provided in place of or in addition to the input unit, wherein the distribution controller distributes output signals from an output device to the output channels on the basis of the positional relation data inputted by one of the input unit and the positional-relationship computing unit.

4. The sound field controller according to claim 1, wherein the weighting-coefficient outputting unit outputs the weighting coefficients so that the sound field changes.

5. The sound field controller according to claim 4, wherein the change of the sound field includes a rotation of the sound field, enlarging and reducing of the sound field, movement of the sound field, and a combination thereof.

6. A computer readable recording medium storing a program for allowing a computer to realize:

a weighting-coefficient outputting function for outputting predetermined weighting coefficients according to a relative positional relationship between a sound field and a listener to distribute signals on a plurality of channels for reproducing the sound field to the plurality of output channels according to the predetermined weighting coefficients;

an inputting function for accepting the input of positional relation data indicating the relative positional relationship; and a distribution controlling function for distributing the signals on the plurality of channels to the output channels on the basis of the outputted weighting coefficients corresponding to the positional relation data whose input has been accepted by the inputting function, wherein the speakers are disposed on a predetermined circumference located around a listener and a distance from a central point of a circle where the speakers are disposed to the predetermined circumference is R, and a distance from the central point of the circle to a virtual circumference where virtual speakers are disposed is r, the virtual speakers being located at virtual positions where the sound image is perceived to be if a direction indicator of the listener has been modified, and if $0<r<R$, a first term, which is a value derived on the basis of the weighting conditions output from the weighting-coefficient outputting unit and a reproduction level for localizing the sound image on the circumference where the speakers are disposed, and a second term, which is a value derived based on the reproduction level for localizing the listening position where the listener is located, are added to generate coefficients (DSP coefficients), and the distribution controller distributes the signal on the plurality of channels to the output channels on the basis of the generated coefficients, and if $r>R$, coefficients (DSP coefficients) are generated by multiplying the weighting coefficients output from the weighting-coefficient outputting unit by $(R/r)^2$ and the distribution controller distributes the signal on the plurality of channels to the output channels on the basis of the generated coefficient.

* * * * *